US005651161A

United States Patent [19]

Asta

[11] Patent Number: 5,651,161

[45] Date of Patent: Jul. 29, 1997

[54] FABRIC COVER FOR A VACUUM HOSE

[75] Inventor: Alfredo Asta, Woodbridge, Canada

[73] Assignee: Vacsoc Inc., Concord, Canada

[21] Appl. No.: 585,610

[22] Filed: Jan. 16, 1996

[51] Int. Cl.[6] ..... A47L 9/24

[52] U.S. Cl. ..... 15/325; 15/339; 138/110

[58] Field of Search ..... 15/325, 339, 257.01, 15/377; 24/432; 138/110

[56] References Cited

U.S. PATENT DOCUMENTS

| | | | |
|---|---|---|---|
| 2,097,475 | 11/1937 | Silberman | 24/432 |
| 4,831,682 | 5/1989 | White | 15/325 |
| 4,899,414 | 2/1990 | Irwin | 138/110 |
| 4,947,506 | 8/1990 | Foster | 15/325 |
| 4,985,942 | 1/1991 | Shaw | 138/110 |
| 5,095,576 | 3/1992 | Galigan | 15/325 |

FOREIGN PATENT DOCUMENTS

| | | | |
|---|---|---|---|
| 233710 | 8/1987 | European Pat. Off. | 15/377 |

*Primary Examiner*—David Scherbel
*Assistant Examiner*—Terrence Till
*Attorney, Agent, or Firm*—Ridout & Maybee

[57] ABSTRACT

A fabric cover for a vacuum hose provides a snug fit about the hose and is easily installed and removed. The cover is an elongate rectangular piece of fabric having a width approximating the circumference of the hose and having parallel longitudinal edges. A zipper or other suitable fastener is attached along the longitudinal edges to provide the means for installation of the cover about the hose. The longitudinal edges are provided with a bead which cover the fastener when the fabric cover is installed on the hose.

4 Claims, 2 Drawing Sheets

FABRIC COVER FOR A VACUUM HOSE

The invention is a fabric cover for a vacuum hose, particularly for a long vacuum hose of the type used in conjunction with a central vacuum system.

A hose for a central vacuum system is typically made of plastic and is about 30 feet long. In order to impart strength and flexibility to the hose, it is corrugated, and it is these corrugations in the hose that can scratch and abrade furniture or other surfaces. One solution to this problem has been to cover the vacuum hose with a sleeve made of a non-abrasive material such as a fabric. A sleeve of this type is disclosed in U.S. Pat. No. 5,095,576 dated Mar. 17, 1992. While effective, sleeve type hose covers have several disadvantages associated with their use. The hose must be threaded through the sleeve, and for the purpose of covering a 30 foot hose, the threading operation is awkward and tedious at best. Because vacuum hoses have metal fittings on each end for attachment purposes, the sleeve must have a circumference sufficient to readily slip over the end fittings. This requirement in turn means that the sleeve is circumferentially oversize in relation to its fit about the corrugated hose itself. Accordingly, prior art sleeve type hose covers need to have means at each end of the sleeve to secure it to the hose, otherwise there is a tendency for the sleeve to slip partly off an end of the hose particularly when the hose is unattached. As the hose cover itself will become soiled with use over time, it is desirable to be able to easily remove and reinstall the cover so that it may be washed when it becomes soiled. Clearly, the sleeve type hose cover does not lend itself to easy installation and removal.

The present invention addresses these various problems and shortcomings of prior art hose sleeves by providing a fabric cover for a vacuum hose which comprises an elongate rectangular piece of fabric having a width approximately corresponding to the circumference of the hose and having parallel longitudinal edges. The cover has fastening means for securing it about the hose which are attached along each longitudinal edge so that upon securement of the cover about the hose, the fastening means are covered by abutting longitudinal edges of the cover. Preferably the fastening means is a zipper, but it may also be another type of fastener such as interlocking hook and loop materials sold under the trademark VELCRO.

Figure 1:
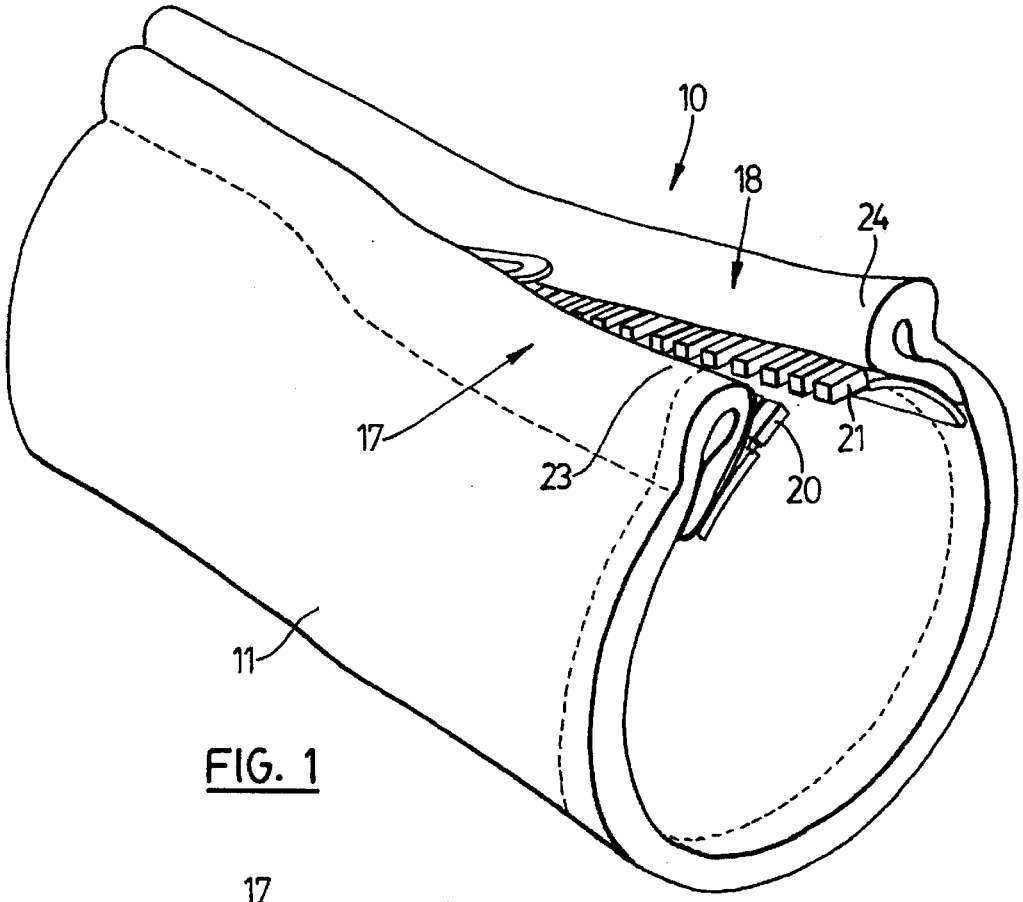
FIG. 1 is a perspective view of a preferred embodiment of the invention having a zippered closure.

The vacuum hose cover 10 of the invention may be made of any suitable non-abrasive fabric 11. It has been found that quilted fabrics having a thin layer of cushioning material 12 sandwiched between inner and outer pieces 13 and 14 of a woven fabric are particularly well suited for use in the invention. The fabric 11 comprising the cover 10 is an elongate rectangular piece having a length corresponding to the length of corrugated hose to be covered, and importantly, the fabric 11 has two parallel elongate edges 17 and 18 defining a width for the rectangular piece approximate to the circumference of the corrugated hose. Thus, when the cover 10 is wrapped about the hose it provides a snug, but not tight, fit.

Figure 2:
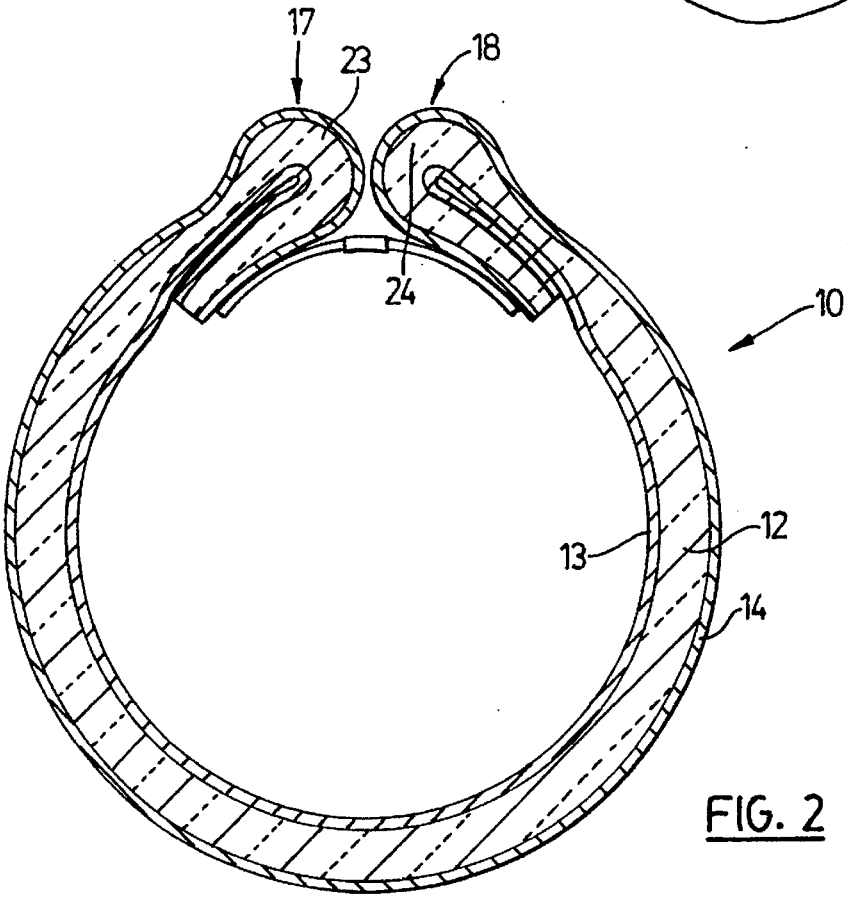
FIG. 2 is a cross sectional view of the device shown in FIG. 1.
Figure 3:
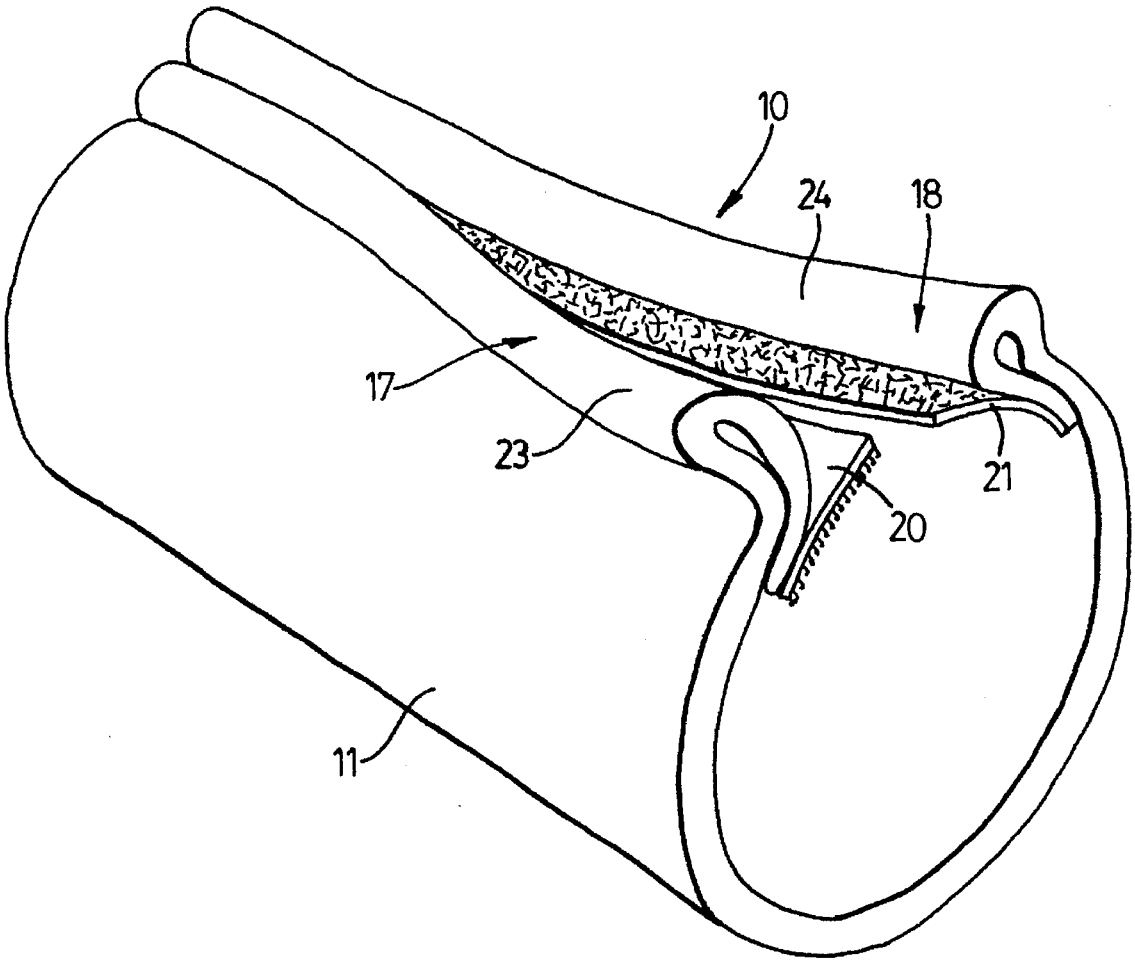
FIG. 3 is a perspective view of an embodiment of the invention having a hook and loop material fastening means.

The longitudinal edges 17 and 18 of the cover 10 are provided with fastening means 20 and 21 which cooperate to provide a releasable securement of the cover 10 about the corrugated hose. As shown in FIGS. 1 and 2, a preferred fastening means 20 and 21 is a zipper, but other suitable fasteners will be apparent to the skilled person and are within the scope of the invention. For example, FIG. 3 illustrates a fastening means 20 and 21 of opposing ribbons of releasably interlocking hook and loop materials such as the type sold under the trademark VELCRO.

By providing the cover 10 with the longitudinal releasable fastening means 20 and 21, it can readily be attached to and removed from the hose. In the case of a zipper fastener, the hose is placed on top of the unfastened cover 10, and the cover 10 is snuggly secured about the hose by simply zipping it up. Of course, it is important that the zipper or other fastening means 20 and 21 does not provide a means for scratching or abrading surfaces along which the hose is moved, so the fastening means 20 and 21 is attached along each edge 17 and 18 so that there is a fabric edge portion 23 and 24 which covers each fastening means 20 and 21. Preferably, each edge portion 23 and 24 is formed by folding under a portion of the edge material to form a longitudinal bead along each edge 17 and 18. The abutting edge beads 23 and 24 efficiently cover the fastening means 20 and 21 when the cover 10 is secured about the hose (FIG. 2), thereby providing a completely non-abrasive covering of the corrugated hose.

From the foregoing, it will be appreciated that the shortcomings of prior sleeve type covers have been addressed by the invention. Thus, the cover 10 is snuggly securable about a vacuum hose so that end securement means are not needed. The cover 10 may be quickly and easily attached or removed so that washing a soiled cover is facilitated.

I claim:

1. A fabric cover for a vacuum hose for a central vacuum system, the hose and cover each being approximately 30 feet long, comprising:

an elongate rectangular piece of fabric having a thin layer of cushioning material sandwiched between inner and outer fabric sheets, the fabric piece having a width approximately corresponding to the circumference of the hose and having parallel longitudinal edges; and releasable fastening means for securing the cover about the hose, the fastening means being attached along each longitudinal edge so that upon securement of the cover about the hose, the fastening means are covered by abutting longitudinal edges of the cover, each longitudinal edge having a bead along its length so that when the cover is secured about the hose, the beads abut and cover the fastening means.

2. A fabric cover as claimed in claim 1, wherein the fastening means is a zipper.

3. A fabric cover as claimed in claim 1, wherein the fastening means is opposing ribbons of releasably interlocking hook and loop materials.

4. A fabric cover as claimed in claim 1, wherein a portion of each longitudinal edge is folded upon itself to form a longitudinal bead, the beads abut one another when the cover is fastened about a hose, thereby covering the fastening means.

* * * * *